US007766333B1

(12) United States Patent
Stardust et al.

(10) Patent No.: US 7,766,333 B1
(45) Date of Patent: Aug. 3, 2010

(54) METHOD AND APPARATUS FOR SHUFFLING AND ORDERING PLAYING CARDS

(76) Inventors: Bob Stardust, 5322 E. Pinchot, Phoenix, AZ (US) 85018; Richard L. Maggio, 5322 E. Pinchot, Phoenix, AZ (US) 85018

( * ) Notice: Subject to any disclaimer, the term of this patent is extended or adjusted under 35 U.S.C. 154(b) by 182 days.

(21) Appl. No.: 12/009,571

(22) Filed: Jan. 16, 2008

Related U.S. Application Data

(60) Provisional application No. 60/881,628, filed on Jan. 22, 2007, provisional application No. 60/900,940, filed on Feb. 12, 2007.

(51) Int. Cl.
*A63F 1/12* (2006.01)

(52) U.S. Cl. ..... 273/149 R; 463/22

(58) Field of Classification Search ..... 273/149 R, 273/149 P; 463/22
See application file for complete search history.

(56) References Cited

U.S. PATENT DOCUMENTS

| | | | | | |
|---|---|---|---|---|---|
| 2,159,958 | A | * | 5/1939 | Sachs | 273/149 R |
| 2,755,090 | A | * | 7/1956 | Aldrich | 273/149 R |
| 2,815,214 | A | * | 12/1957 | Hall | 273/149 R |
| 4,310,160 | A | * | 1/1982 | Willette et al. | 273/149 R |
| 4,770,421 | A | * | 9/1988 | Hoffman | 273/149 R |
| 4,969,648 | A | * | 11/1990 | Hollinger et al. | 273/149 R |
| 5,000,453 | A | * | 3/1991 | Stevens et al. | 273/149 R |
| 5,275,411 | A | | 1/1994 | Breeding | |
| 5,356,145 | A | * | 10/1994 | Verschoor | 273/149 R |
| 5,692,748 | A | | 12/1997 | Frisco | |
| 2003/0073498 | A1 | | 4/2003 | Grauzer | |
| 2005/0110211 | A1 | | 5/2005 | Blad | |

OTHER PUBLICATIONS

Trailing The Dovetail Shuffle To Its Lair, Ann. Appl. Probability 2, 294-313, 1992.

* cited by examiner

*Primary Examiner*—Benjamin H Layno
(74) *Attorney, Agent, or Firm*—Schmeiser, Olsen & Watts LLP

(57) ABSTRACT

A card shuffling system and method operates with four card hoppers arranged into first and second pairs. In the operation of the system, a first pair of card hoppers holds approximately two halves of a deck, which are then selectively interlaced together and supplied to the other pair of hoppers with the cards interlaced first into one of the second pair of hoppers and then into the other. The cards then are selectively interlaced from the hoppers of the second pair of hoppers back to the hoppers of the first pair of hoppers, with the operation being repeated, if desired.

21 Claims, 7 Drawing Sheets

Fig 7

| Storage compartment number | Order of half decks as loaded | Order in first pass | Order of output first pass | Position in new stack | Order of input 2nd pass |
|---|---|---|---|---|---|
| 651 | 1 | 1 | ----- | ----- | ----- |
| 652 | 2 | 3 | 2 | 11 | 9 |
| 653 | 3 | 5 | 4 | 9 | 5 |
| 654 | 4 | 7 | 6 | 7 | 1 |
| 655 | 5 | 9 | 8 | 5 | 8 |
| 656 | 6 | 11 | 10 | 3 | 4 |
| 657 | 7 | 2 | 1 | 12 | 11 |
| 658 | 8 | 4 | 3 | 10 | 7 |
| 659 | 9 | 6 | 5 | 8 | 3 |
| 660 | 10 | 8 | 7 | 6 | 10 |
| 661 | 11 | 10 | 9 | 4 | 6 |
| 662 | 12 | 12 | 11 | 2 | 2 |

METHOD AND APPARATUS FOR SHUFFLING AND ORDERING PLAYING CARDS

RELATED APPLICATIONS

This application corresponds to, and claims the benefit of priority under Title 35 U.S.C. Sec. 119(e) of U.S. provisional applications, Ser. No. 60/881,628, filed Jan. 22, 2007, and Ser. No. 60/900,940, filed Feb. 12, 2007, both incorporated herein by reference.

FIELD OF INVENTION

This invention relates to a playing card shuffling device, specifically a random number generator driven playing card interlacing device.

BACKGROUND OF THE INVENTION

Before there were automatic single deck card shufflers, casinos had card dealers hand shuffle cards for games played with a single deck, such as poker. Once in a while between hands, the dealer would also have to count the deck to make sure the number of cards in the deck was still correct. When the decks are no longer needed for a particular game, the game breaks, or a new setup is brought in, two new decks, a casino employee would have to do a setup, put the cards back in original order, so the cards can be spread and checked at the start of the next game. Doing a setup putting a scrambled deck back in its original order, is something casinos still have to do by hand.

The method of shuffling most often used by professional poker dealers is a five step process referred to as scramble, riffle, riffle, strip, riffle. A scramble is when a deck of cards is spread out face down on the table by the dealer and then randomly mixed around together by the dealer using both hands in a circular motion. The cards and then gathered together into a pile, picked up, and straightened out into a deck again. Some casinos, for expediency, have eliminated the scramble.

In the second step the riffle, or dovetail shuffle, a deck of cards is first cut about midway into two half decks. Cards from the two half decks are then riffled, or interlaced, together again to form one deck. This process is repeated a second time. The next step is known as the strip, or box. The dealer holds the deck and removes approximately the top quarter of the deck and places it on the table. The dealer then removes the next group of cards, about a quarter of a full deck, and places this second group of cards on top of the first group of cards already on the table. This is repeated again, with the dealer placing a third group of cards, about one quarter of the deck, on top of the second group of cards. The last remaining group of cards, the bottom quarter of the deck, is then placed on top of the cards on the table. Essentially, the deck is divided into four parts, and the parts put in inverse order. After the strip or box, the dealer does another riffle to complete the shuffle. The deck is then ready to cut and deal.

Another method of shuffling, which results in a mathematically provable random shuffle, would be for a dealer to simply do seven riffle shuffles, instead of the standard riffle, riffle, strip, riffle. This is not done in casinos as it would be time consuming. The random outcome of this method was proven through mathematical modeling by David Bayer and Persi Diaconis, in their paper "Trailing the Dovetail Shuffle to Its Lair" (Ann. Appl. Probability 2, 294-313, 1992). They showed that after seven random riffle shuffles, of a deck of 52 cards, every configuration or outcome is possible and nearly equally likely, and that more shuffles would not increase the degree of randomness in the deck. The mathematical model of the riffle shuffle they used is called the GSR (Gilbert, Shannon, Reeds) model. Following the publication of that paper, much research was done by others to investigate the same question using different methods. The subsequent research proved the validity of the GSR model and the conclusions of Bayer and Diaconis.

The device of the current invention can shuffle a deck of cards in either manor. It can do the industry standard acceptable riffle, riffle, strip, riffle, or it can do the mathematically proven seven riffles. It can also cut the deck, count the deck, verify that there is one and only one of each card, and do a setup.

PRIOR ART

Two designs are currently enjoying commercial success today, with enough speed and randomness to be used as single deck shufflers in the heavily regulated casino environment. They are U.S. Pat. Application publication Nos. 20050110211 (to Blad, Steven J.; et al.) and 20030073498 (to Grauzer, Atilla; et al.); No. 20050110211 discloses a method a shuffling machine relying on random ejection technology. U.S. Pat. No. 20030073498 discloses a random insert device. It operates by a position of the elevator being randomly selected and the support surface is moved to the selected position, and after the gripping arm grasps at least one side of the cards, the elevator lowers, creating a space beneath the gripping arm, wherein a card is moved from the infeed compartment into the space, thereby randomizing the cards. Both are one pass devices that take an input deck and use a random number generator (RNG) to directly build an output deck.

Many mechanical interlacing devices have also been patented to shuffle cards. U.S. Pat. No. 5,275,411 (to Breeding) discloses the most recent of that type of design. A carriage mechanism separates the deck into two deck portions, rotates the two portions to a relative angular relationship with a corner of each in close proximity, riffles the portions, and combines them into a single shuffled deck. Mechanical interlacing devices have the greatest speed, but their problem is that their degree of randomness can not be assured.

U.S. Pat. No. 5,692,748 (to Frisco, et al) discloses a device which uses a RNG to repetitively cut a deck and interleave. It is a device and method for shuffling a stack of N cards. The stack is positioned at a cutting station where the card stack is cut into unequal portions (N/2)−A and (N/2)+A. The cards from each portion are then deposited in an interleaving fashion. The additional quantity of cards A of one of the portions is transported from proximate the center of the stack N to the top of the shuffled stack. Further cutting and interleaving randomly distributes the cards in the stack.

U.S. Pat. No. 5,692,748 (to Frisco, et al) discloses a device which has to reload between interleaving. Cards are interleaved to an output stack, which then has to be moved by elevator back to the cutting station, where the output is then cut into two stacks to be interleaved again.

U.S. Pat. No. 5,692,748 (to Frisco, et al) claims to be useable for shuffling multiple decks of cards, e.g. two to six decks. The amount of interleavings necessary to obtain a random shuffle increases dramatically as the number of cards to be shuffled increases. The time it would take to provide the amount of interleavings necessary to shuffle six decks of cards at once to achieve a sufficient degree of randomness renders the device impractical.

In the above noted prior art there are no devices, RNG driven or not, designed to do repetitive interleaving between two different sets of hoppers with each set of hoppers alternately functioning as receiving and sending hoppers. There also are no shufflers that can do a riffle, riffle, strip, riffle.

SUMMARY OF THE INVENTION

This invention is a microprocessor driven mechanical card interlacing device that can be used to shuffle cards in one of two fashions. In one mode of shuffling, the device of the invention simulates the standard traditional riffle, riffle, strip, riffle shuffle a casino card dealer would do by hand. In another mode of shuffling the device of the invention simply does enough repetitive riffle shuffles to achieve a mathematically provable random shuffle. The device of the invention also verifies that there are the correct number of cards present during each shuffle, and can put a scrambled deck back in order.

OBJECTS OF THE INVENTION

An object of this invention is to build an automatic card shuffler of very simple design, which eliminates the jamming problems associated with the automatic shufflers currently in use; reduces the cost of building an automatic shuffler; and reduces shuffle time compared to other automatic card shufflers.

Another object of the invention is to create an improved automatic card shuffling device using a proven mathematical model of card shuffling to drive repetitive interlace shuffle, thereby outputting a shuffled deck that is a mathematically provable random deck.

Another object of the invention is to create a card shuffling device that can simulate the industry accepted method of shuffling known as the riffle, riffle, strip, riffle.

BRIEF DESCRIPTION OF THE DRAWINGS

FIG. 7 is a table showing features of operation of the embodiment shown in FIG. 6.

DETAILED DESCRIPTION

In Table Single Deck Design

Figure 1:
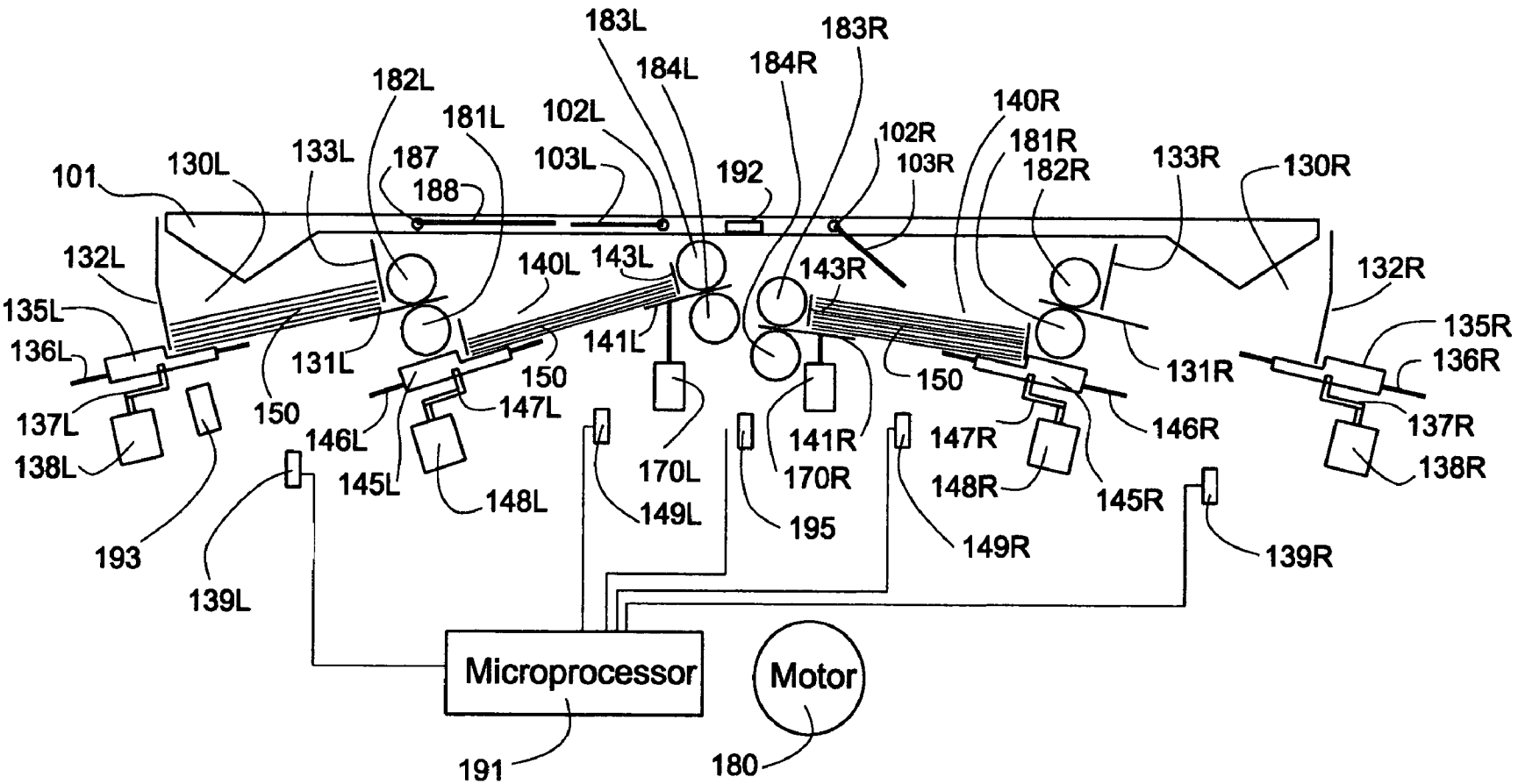
FIG. 1 is a front cross section view of an embodiment of the invention.

The device of FIG. 1 is a repetitive interlacing card shuffling apparatus wherein all card movements are not left to chance but are predetermined by a microprocessor 191. The operator selects the mode to run in: riffle, riffle, box, riffle, or a certain number of riffles. The microprocessor 191 runs a mathematical model, or simulation, for the next shuffle. The apparatus then performs the shuffle by mechanically moving the cards in accordance with the random shuffle generated by the microprocessor.

The apparatus contains four card hoppers, which work in pairs. The two on the left (130L and 140L) are pairs and the two on the right (130R and 140R) are pairs. One pair of hoppers holds the two halves of a deck which are to be interlaced together. The other pair of hoppers receive the interlaced cards. Cards are interlaced first into one empty hopper and then into the other empty hopper. The two hoppers that received the interlaced cards now become two new half decks for the next interlacing. The cards are then interlaced from the now full hoppers back into the empty hoppers. The pattern by which the cards are selectively interlaced and the point at which output is shifted from the first output hopper to the second output hopper, cutting the deck for the next shuffle, is controlled by the microprocessor, which directs the action of the shuffle in accordance with the last shuffle simulation that it ran. The device can also do a riffle, riffle, strip, riffle. With the ability to move cards between four hoppers, the device can divide a deck into four quarters and then reassemble the deck with the four quarters in inverse order.

Referring to FIG. 1, the top of lid 101 is flat. Under the top most surface of lid 101 is a layer of sound deadening insulation, not shown. The center underside of lid 101 is flat and serves as a glide path for cards being moved between hoppers, as will be explained. On each end of the underside of lid 101 is a bump which, as will be explained later, serves to direct any cards gliding past the bumps downward into the hoppers below the bumps. An alternative design wold eliminate the bumps and instead provide cushioning on upright walls 132L and 132R so cards glide along the underside of lid 101, hit the upright walls and fall straight downward into the hoppers below. The rest of the outer housing is irrelevant to the operation of the device, except to provide places for mounting the various components which will be described herein.

Three swing arms are mounted to lid 101: left inner hopper diverter 103L, right inner hopper diverter 103R, and cut diverter 188. Left inner hopper diverter 103L and right inner hopper diverter 103R are mirror images. Left inner hopper diverter 103L is shown in its retracted position. Right inner hopper diverter 103R is shown in its extended position. Cut diverter 188 is shown retracted; it extends in the same fashion as right inner hopper diverter 103R. The movement of all three diverters 103L, 103R, and 188 are controlled by respective positioning devices 102L, 102R, and 187. These positioning devices consist of rotary solenoids, but other positioning mechanisms could be employed.

An electric locking mechanism is incorporated into lid 101 to prevent lid 101 from being opened while playing cards 150 are being launched against the underside of lid 101, as will be explained.

Four card hoppers are shown: left outer hopper 130L, left inner hopper 140L, right outer hopper 130R, and right inner hopper 140R. Except for some movable pieces which will be noted, most of the pieces that make up the hoppers are fastened to the front and back walls of an outer case, which is not shown. The distance between the front and back walls is a little more than the height of a standard playing card. Playing cards 150 are shown in three of the hoppers 130L, 140L and 140R.

Left outer hopper 130L is formed by upright walls 132L and 133L, slotted guide 131L and slide 135L. There is a gap of about 1.5 times the thickness of a playing card between upright wall 133L and slotted guide 131L.

An alternative design would eliminate upright wall 133L, and instead rely on the use of a suitable takeoff speed to ensure that only one card at a time is removed from the hopper. Movable fingers, not shown, could be employed to straighten the cards up if needed.

Above and below slotted guide 131L are upper and lower propelling wheels 181L and 182L. Slotted guide 131L is slotted to allow a card sliding along slotted guide 131L to contact both upper and lower propelling wheels 181L and 182L at the same time.

Slide 135L is narrower than the height of a card and protrudes through an opening in upright wall 132L, and is movable along guide rail 136L. It is moved back and forth along guide rail 136L by crank 137L which is driven by stepper motor 138L. The top of slide 135L has a step in it no higher than the thickness of a playing card 150.

Below left outer hopper 130L is left outer hopper electric eye sensor 139L. Right outer hopper 130R is a mirror image of left hopper 130L, except for left outer hopper 130L having read head 193 below and off to the side of slide 135L.

Right inner hopper 140R is the same as right outer hopper 130R except that upright wall 143R, slotted guide 141R, and upper and lower propelling wheels 183R and 184R are mounted as a movable assembly on solenoid 170R instead of being mounted to the outer case. Left inner hopper 140L is a mirror image of right inner hopper 140R. Solenoid 170R is shown in its retracted position. Solenoid 170L is shown in its extended position.

All of the propelling wheels are driven by motor 180 through conventional couplings (not shown). Lower propelling Wheels 183L and 181L are driven clockwise. Lower propelling wheels 184R and 181R are driven counter clockwise; Upper propelling wheels 183L, 182L, 183R, and 182R are driven in an opposite of direction to their corresponding lower propelling wheels. A basic drive system is used, such as a continuous belt, but has not been shown in order to simplify FIG. 1. Also disclosed on FIG. 1 is middle electric eye 195, and microprocessor 191. A cooling fan may be employed but is not shown.

Figure 2:
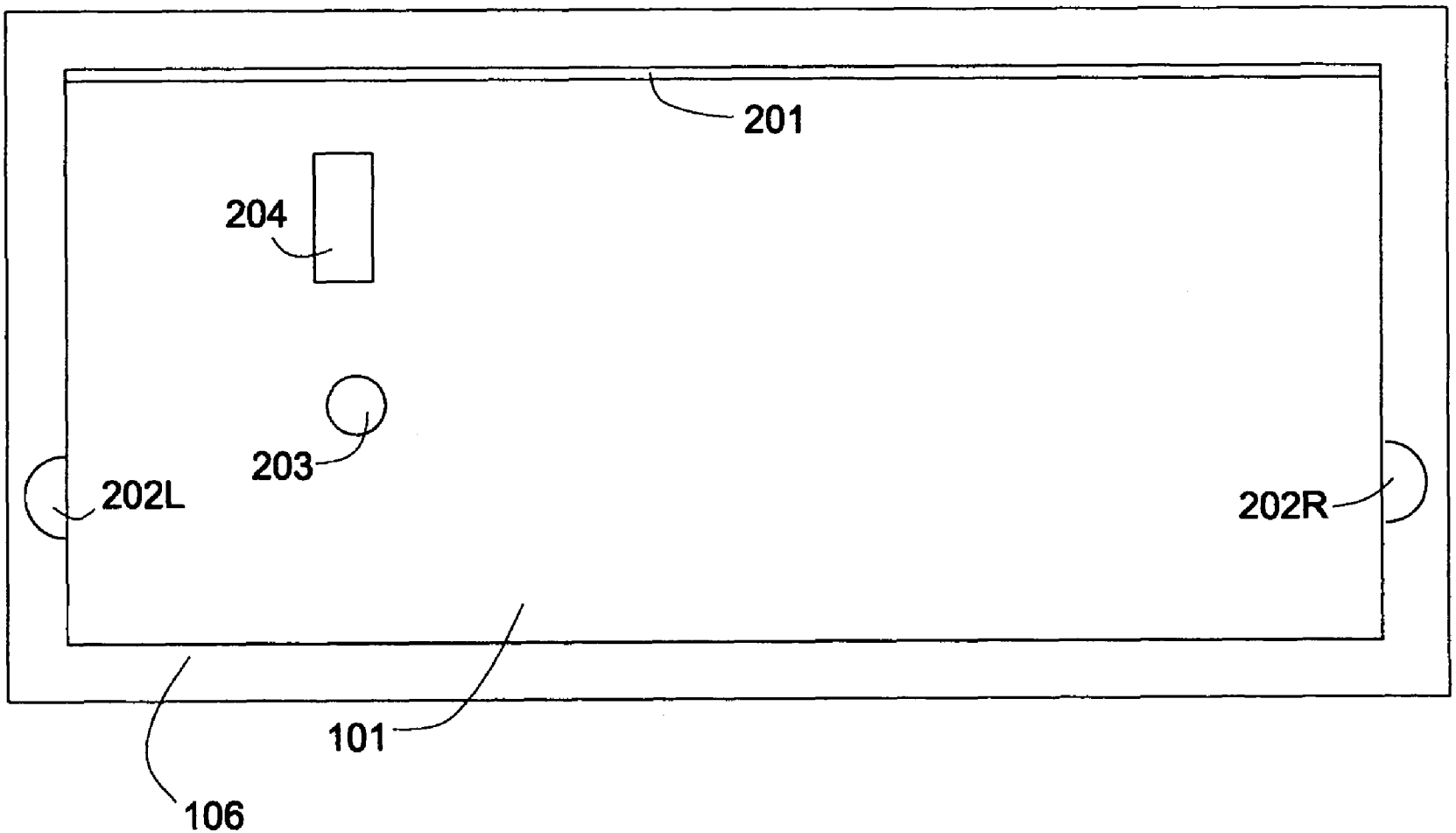
FIG. 2 is the top view of the device of FIG. 1.

Referring to FIG. 2, lid 101 is shown mounted to the top of outer case 106 by means of hinge 201. Thumb holes 202L and 202R are provided for manually opening the lid. Pushbutton (s) 203 and external display panel 204 are flush mounted in the top of the lid 101.

Operation—in Table Single Deck Design—Riffle Only Mode.

The operator first straightens up a deck of cards by turning all cards to face in one direction and tapping the edges of the deck relatively smooth. The operator then opens lid 101 by pressing pushbutton 203 on outer case 106. Pushbutton 203 activates a standard automatic lid opening mechanism which is not shown. The operator then places the deck of cards face down in left outer hopper 130L, resting on slotted guide 131L and slide 135L. Electric eye 139, or a proximity sensor, not shown, senses the presence of cards 150 and signals microprocessor 191 to begin a shuffle. Microprocessor 191 then deactivates the automatic lid opening mechanism, activates a lid locking mechanism (not shown), turns on motor 180, and runs a shuffle simulation. The shuffle simulation determines all the moves the system is going to make to execute a shuffle in accordance with the simulation. Motor 180, which drives all the propelling wheels will continue to run at constant speed until the shuffle is complete.

The simulation run by microprocessor 191 randomly determines where the deck placed in the hopper 130L is going to be cut into two parts for each shuffle, and how the two parts are going to be interlaced for each shuffle. The actual physical shuffle commences once the first random number is generated by the microprocessor, which is where the deck will be cut into two half decks for the first interlacing. To commence the actual physical shuffle cut, diverter arm 188 is extended downwardly from the position shown in FIG. 1. Stepper motor 138L (FIG. 1) is activated which turns crank 137L, which in turn moves slide 135L forward and back. On its forward movement slide 135L engages a card and slides it forward into propelling wheels 181L and 182L. The propelling wheels thrust the card forward, whereupon the playing card hits cut diverter arm 188 and falls into left inner hopper 140L. This process is repeated for the number of cards needed cut the deck at the point determined by the microprocessor for the shuffling simulation that was run. Cut arm 188 is then retracted back to the position shown in FIG. 1. Each half deck is still in its original order. With the deck now divided into two parts and both parts in hoppers on the same side of the device, 130L and 140L, the process of interlacing commences.

Solenoid 170R is retracted. Cards are then interlaced one at a time from either left inner hopper 140L or left outer hopper 130L by microprocessor 190 activating the appropriate hopper stepper motor, 138L or 148L. With cut arm 188 and diverters 103R and 103L retracted, any cards leaving either left inner hopper 140 or left outer hopper 130L are propelled against lid 101 whereupon they slide along the underside of lid 101 until the bump on the right end of the underside of lid 101 deflects the playing card into right outer hopper 130R.

This process of interlacing cards into right outer hopper 130R continues until right outer hopper 130R contains the predetermined number of playing cards 150 for the new first half deck for the next interlacing. At that time right inner hopper diverter 103R is extended downwardly to the position shown in FIG. 1 and the interlacing, as described above continues. With diverter 103R extended, however, the cards now slide against the underside of lid 101 and are diverted into right inner hopper 140R, instead of right outer hopper 130R. This continues until all cards have been interlaced from left hoppers 130L and 140L to right hoppers 140R and 130R.

Electric eyes 139L and 149L are used to make sure there are cards in the hoppers when there should be, as well as to make sure the hoppers are empty when they should be. That is how microprocessor 191 determines whether or not there is the correct number of cards. Electric eye 195 monitors the process for any jams. It should be blocked for only a fraction of a second every time a card is moved past the gap sensed by the electric eye 195. This action of moving the cards from left to right as just described accomplishes one riffle shuffle and also divides the riffled cards into two new half decks, cuts the deck, for the next riffle shuffle. Solenoid 121R is then extended, solenoid 141L is retracted; and the above procedure is repeated while moving cards from right to left to accomplish a second riffle shuffle. Successive riffle shuffles are accomplished each time the cards are moved from the hoppers on one side to the hoppers on the other side. On the last riffle shuffle, right diverter 103R is not extended, causing all of the shuffled cards to accumulate in right outer hopper 130R. Microprocessor 191 then activates a light on external display panel 204 signaling the user that the shuffle is complete. The user can then open lid 101, place a new deck to be shuffled in left outer hopper 130L and remove the shuffled deck from right outer hopper 130R. While the above discussion designated certain hoppers for input and output, the device could be built with any hopper as the designated input hopper and any other hopper as the designated output hopper. Cards could also be moved end first instead of side first.

Operation—in Table Single Deck Design Riffle, Riffle, Strip, Riffle Mode.

In this mode of operation, two riffle shuffles are done as described above, resulting again in a new first half deck in left outer hopper 130L and a new second half deck is in left inner hopper 140L. To begin the strip step of the shuffle a predetermined number of cards, determined by shuffle simulation run by microprocessor 191, approximately half of the cards in left outer hopper 130L, are fed into a right hopper, which hopper does not matter, and then immediately fed back into left outer hopper 130L. The second half of the cards in left outer hopper 130L are now on top of the first half of the cards in left outer hopper 130L. This makes the order of the quarters of the deck in the left outer hopper 130L as 2, 1. This process is then repeated for the cards in the lower left 140L, resulting in the second half of the cards in left inner hopper 140L on top of the first half of the cards in left inner hopper 140L. This makes the order of the quarters of the deck in the left inner hopper 140L as 4, 3.

The quarters of the deck are now 2, 1 in left outer hopper 130L and 4, 3 in left inner hopper 140L. Left outer hopper 130L and left inner hopper 140L are normally considered by the microprocessor 191 to be the new first and second half decks respectively. If the order needs to be 4, 3, 2, 1 to finish the strip, microprocessor 191 switches which hoppers it considers to be the new first and second half decks. The quarters 4, 3 in left inner hopper 140L are now treated as the new first half deck and 2, 1 in left outer hopper 130L is now considered the new second half deck. The strip part of the shuffle is now complete. The cards are then riffled together into right outer hopper 130R as described above, and the industry standard riffle, riffle, strip, riffle shuffle is complete.

Operation—Deck Check

Checking the deck can take place while the shuffler is running in either of the two above described modes. Checking the deck involves verifying that there is one and only one of each card present, no missing cards, and no duplicates. This step is necessary to insure there is a proper deck present, and is separate from just verifying that there are the correct number of cards present, which is part of the above outlined shuffling processes.

Checking the deck is done by the use of read head 193 and pattern recognition technology, with no mechanical changes to the device or how it operates. Read head 193 can be used read each card taken out of the upper left hopper during the normal course of a shuffle. The images generated are compared to stored images to identify each card by rank and suit, and thereby verify the integrity of the deck. If an error is found microprocessor 191 lights an error light on user display panel 204, and sends an error message to user interface panel 192. Read head 193 easily may be placed in a different location. Its particular placement is of no importance, as long as it can see at least a corner of each card.

Running a deck check does not slow a shuffle. If needed, the shuffle could be completed as usual, and the images stored and processed as the physical shuffle is run. A learn mode would be employed. Switch to learn mode, using user interface panel 192, and put a new deck through. The microprocessor remembers each card and the proper order of cards, and uses this information to check that all cards are present in a deck, as well as to put a deck back into proper order, if desired, as is outlined in the next section.

Operation—Doing a Setup

To do a setup the operator opens the lid 101, using pushbutton 203, removes any shuffled deck from right outer hopper 140R, selects setup mode using a pushbutton under lid 101 (pushbutton not shown), and inserts the deck to be set up into left outer hopper 130L. Microprocessor 191 then closes the lid and commences to remove playing cards 150 one at a time from left outer hopper 130L. Read head 193 reads each card 150 as it is being removed from left outer hopper 130L, and feeds this information to microprocessor 191. Microprocessor 191 identifies the rank and suit of each card leaving left outer hopper 130L and uses that information to direct the card leaving left outer hopper 130L into either inner right hopper 140R or outer right hopper 130R, depending on the rank and suit of the card. The decision of which hopper to use is obtained by microprocessor lookup on a table that has been input which contains all the moves a card needs to make, based on its rank and suit, to transform a scrambled back into its original order. Microprocessor 191 then moves the cards from the left hoppers to the right hoppers, again depending on the rank and suit of each card and a table lookup. Using one particular algorithm, a few passes gets the cards into order by rank, the next pass by rank and color, and the last pass by rank and suit.

Upon completing the setup, the device automatically resets to shuffle mode, as it would be highly undesirable to have the device in setup mode when shuffling a deck is desired. Also, to prevent confusion a setup deck would be returned to the operator in the same hopper as input, so as not to be confused with a shuffled deck, which is returned to the operator in a different hopper.

Each time a card is moved, microprocessor 191 stores the locations of which cards have been placed into which hoppers and in what order. Reading the rank and suit of each card more than once is therefore not necessary.

Alternative Embodiments

Minor Design Changes

Many modifications can be made to the current device, such as the placement of the hoppers, the angle of the hoppers, and the distance between hoppers. By putting more separation between the left and right pairs of hoppers, the middle hoppers would not have to bow out of the way. Aimable hoppers could also be employed, possibly eliminating the need for diverters. Minor changes could also include the number, shape, and placement of guides, glides, and or deflectors, the method of providing movement to cards and different components, and the shape and points of attachment of different arms. All are variations of the same device which has been described above.

For an in table design, as previously presented, it is desirable to have the hoppers laid out so the entire card path is reachable by opening the top lid, since that is the only readily accessible side of the device. For off table designs, the length of the device may be shortened by partially or completely recessing the inner hoppers under the outer hoppers. In off table designs, a side door by itself, or in addition to a top door, could be provided to access the entire card path. With a side only door, internal lighting would be provided to assist the operator in viewing the entire card path, with such lighting to be controlled by a switch so that the internal lights would illuminate when the side door is opened.

In a design that partially or completely recesses the inner hoppers under the outer hoppers, cut diverter 188 would be eliminated. Two other methods could be employed in order to cut a deck of cards, to get a full deck of cards contained in left outer hopper 130L into two half decks in different hoppers on the same side. First would be to move half of the cards to a right hopper, and then move the same cards from the right hopper to left inner hopper 130L. Second would be to move half of the cards to a right hopper, and then move the other half of the cards to the other right hopper. Either method would get an input deck of cards divided into half decks of cards with both half decks of cards on the same side of the device and therefore ready to be interlaced.

One alternative embodiment is the addition of pressure arms. When advancing cards out of a hopper it may be desirable to put a slight downward weight on the last few cards to make sure they feed. This can easily be accomplished in by a spring tension finger or alternative means (not shown).

An alternative to the stepped slide to push the cards would be a vertical standing cam which pivots back and forth. The top of the cam would be an arc with a step in it to engage a card. This alternative would impart some up and down movement to the cards in the hopper and probably require a pressure arm to keep the cards from bouncing and not engaging. Another alternative embodiment would be to have the card sit on a fixed shelf with only a thin sliding piece used, to push against the bottom card. Still another embodiment would be to use a drive wheel to start the cards moving, instead of a side push mechanism.

Alternative Embodiment

Off Table Single Deck Design

The basic embodiment, as has been described, is intended for use at a poker table, where it would be flush mounted into the top of the poker table since no other room is available at a poker table. The dealer should only have one deck of cards out of the shuffler at any time. The dealer places a deck of cards to be shuffled into the shuffler and removes a deck of shuffled cards out of the shuffler.

Some other single deck card games, such as pai gow, are usually dealt at blackjack tables. At blackjack tables there is room for a shuffler to be placed next to the dealer. In these games it is also desirable to deliver only a certain number of shuffled cards at a time to the dealer. In these games it is desirable to have a separate output hopper to deliver groups of cards to the dealer, and a separate input hopper to hold the next deck to be shuffled so that two decks of cards are not out of the shuffler at the same time where they could possible be mixed together. The basic shuffler design can accommodate such other single deck card games with the addition of two additional hoppers, one to hold the next deck to be processed, and one to hold output being delivered to the operator.

Detailed Description

Off Table Single Deck Design

Figure 3:
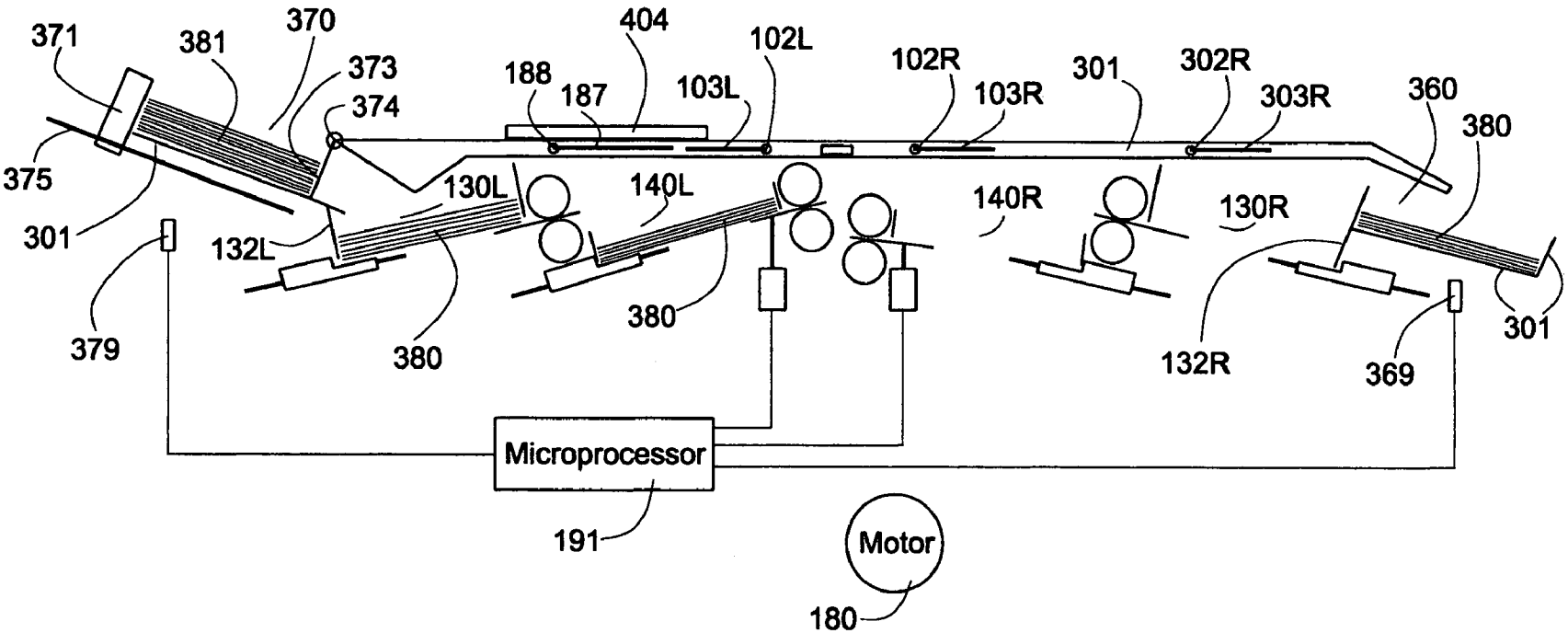
FIG. 3 is a cross section of another embodiment of the invention.

Referring to FIG. 3, an immovable part of outer case 301 now replaces top lid 101. Similar to the lid 101, the underside of outer case 301 is flat and serves as a glide path for cards being moved between hoppers. On each end of the outer case 301 is a downward projection which serves to deflect any cards gliding past the projections into the hoppers below the downward projections.

Left inner hopper diverter 103L, right inner hopper diverter 103R, cut diverter 188, and their respective positioning devices 102L, 102R, and 187 are attached to outer case 301, the same as described previously as being attached to lid 101. Replacing what was the bump on the right underside of lid 101 is now right outer hopper diverter 303R, which is moved by positioning device 302R, which function the same as right inner hopper diverter 103R and positioning device 103R. Also shown is user interface panel 404.

The four card hoppers previously described, left outer hopper 130L, left inner hopper 140L, right outer hopper 130R, and right inner hopper 140R, are again shown and are identical to those previously described, except for two walls being shorter: upright wall 132R and left outer hopper wall 130L. Input hopper 370 is shown, holding deck to be shuffled 381. Deck being processed 380 is shown in the left inner and outer hoppers 130L and 140L and output hopper 360. Deck to be shuffled 370 rests against part of outer case 301, as is more clearly illustrated in FIG. 4, and spring door 373, which is shown held in its normal closed position by spring hinge 374 which is attached to outer case 301. Spring door 373 swings all the way to the right flush against outer case 301 when the door 373 is opened.

To the left of deck to be shuffled 381 is pusher 371, shown in its retracted position in FIG. 3. Pusher 301 is extended to the right along rail 375. A solenoid, not shown, or other mechanism is used to move pusher 371, or a wheel drive or other mechanism may be used to move deck to be shuffled 381 in a similar fashion. Below input hopper 370 is electric eye 379. Below output hopper 360 is electric eye 369. Output hopper 360 is shown formed by outer case 301, as is more clearly illustrated in FIG. 4.

Figure 4:
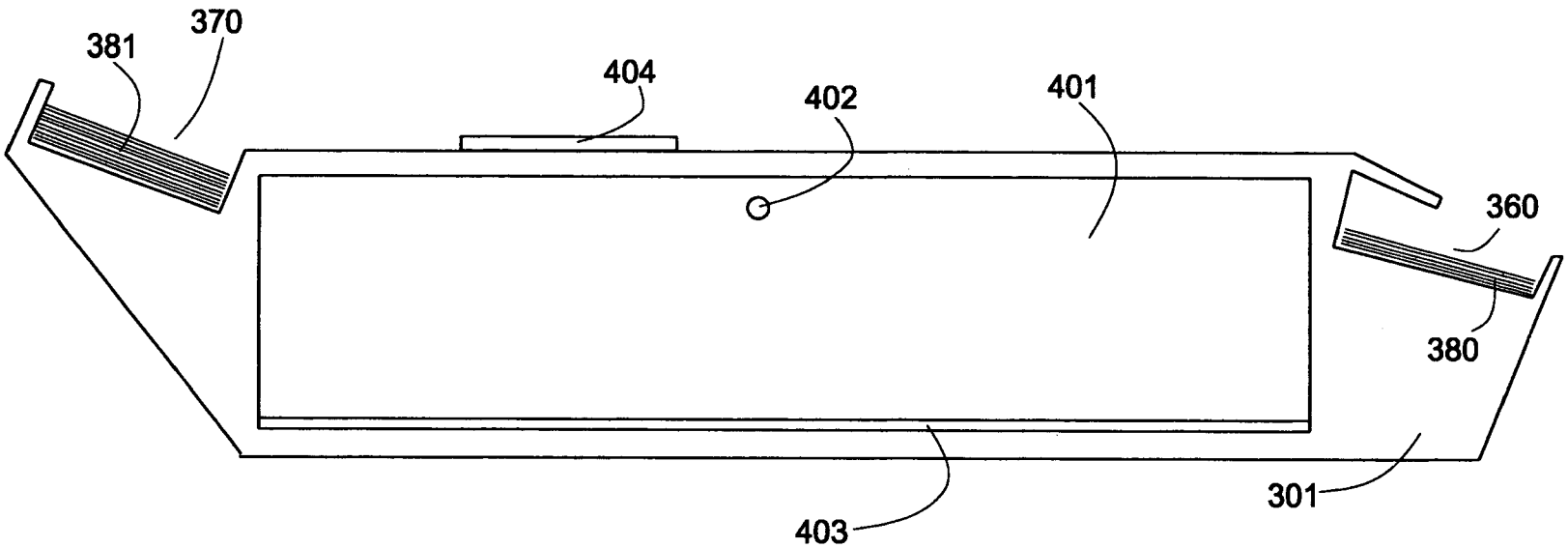
FIG. 4 is a view of the outside of the device of FIG. 3.

Referring to FIG. 4, outer case 301 shows the placement of input hopper 370, containing deck to be shuffled 381, and output hopper 360, containing deck being processed 380. User interface panel 404 is shown on top. Side access door 401 is shown on the side, which is opened by handle 402, and pivots on hinge 403.

With the single deck in table design discussed previously, the top lid is necessary to access the complete card path to unjam any cards, as the top would be the only readily accessible side of the device. With an off table design, a side access panel is possible, and is used to access the entire card path in an alternative embodiment wherein inner hoppers 140L and 140R are placed partially or completely under their respective outer hoppers, 130L and 130R, to shorten the length of the device. With side access door 401 being used, internal lights, not shown, are placed within outer case 301 to assist the operator in spotting any problems. A switch, also not shown, is provided to turn on the internal lights when access door 401 is open.

Operation—Off Table Single Deck Game Design

When the shuffler is first put at a gamming table, it is set up for the game to be played at that table by the operator using interface panel 404. The information needed to be input is the number of cards in a deck to be used for the game, the number of cards to be output at a time, the maximum number of players for the game, and the method of shuffling to be used. Once that information is inputted to microprocessor 191, the shuffler can be used as needed, and the information not inputted again unless the shuffler is needed for a different game.

To use the shuffler, an operator places deck to be shuffled 381 into input hopper 370. Electric eye 379 (or proximity sensor or other mechanism) signals the microprocessor 191 that a deck to be shuffled 381 has been input. Since inner and outer hoppers 130L, 140L, 130R, and 140R are empty microprocessor 191 commences a shuffle by activating pusher 371 to push deck to be shuffled 381 past spring door 373 and into left outer hopper 130L whereby deck to be shuffled 381 is now deck being processed 380.

Microprocessor 191 then commences to shuffle deck being processed 380 by moving cards between inner and outer hoppers 130L, 140L, 130R, and 140R as previously described for the method of shuffle that was selected by the operator. Right outer hopper diverter 303R is extended downwardly and left extended during the shuffling process to get deck being processed 380 into right outer hopper 130R. On the last step of the shuffle deck being processed 380 is not interlaced into right outer hopper 130R but instead left in left hoppers 130L and 140L until needed by the operator.

At the end of a game the operator places another deck to be shuffled 380 into input hopper 370. Microprocessor 191 retracts right outer hopper diverter 303R. Microprocessor 191 then interlaces the number of cards needed for a hand from left hoppers 130L and 140L into output hopper 360. The cards are then removed from output hopper 360 by the operator to be delivered to a player. Electric eye 369, or other sensing device, signals cards being removed from output hopper 380 to microprocessor 191, which then interlaces the next group of cards needed into output hopper 360. This process is repeated until the maximum number of hands has been reached. All remaining deck being processed 380 is then interlaced into output hopper 360 where they are removed by the operator. Once those cards have been removed by the operator, the process is repeated with next deck to be shuffled 381 being moved from input hopper 370 to left outer hopper 130L.

An alternative design for the placement of input hopper 370 would be to place input hopper 370 directly above another hopper such as left outer hopper 130L. In this embodiment, instead of deck to be processed 381 being slid from input hopper 370 into left outer hopper 130L, deck to be processed 381 would simply be dropped into left outer hopper 130L.

Alternative Embodiments

Multiple Deck Games

The game of blackjack can be played with multiple decks of cards at the same time, typically, two, four, six, or eight decks. Different embodiments of the invention can accommodate shuffling multiple decks of cards, two of which will be discussed.

The first embodiment, multiple deck single pass, allows each card to make only one pass through the shuffler. In this embodiment clumps of similar cards are first broken down. If there are many aces in the beginning of the deck to be shuffled, it is desirable to get that clump broken down and the group of similar cards randomly distributed throughout the final shuffled multiple deck stack of cards. Once the clumps are broken down, the second step is done is to randomize individual cards. If three aces came up in a row in the deck to be shuffled, we do not want three aces in a row to come up again in the output deck.

The second embodiment, multiple deck multiple pass, allows the embodiments of the invention to duplicate the industry standard ABC hand shuffle, which dealers use to shuffle multiple deck stacks of cards at a time. A dealer also can not shuffle more than one deck of cards together at a time. The ABC shuffle is a sequence of steps, whereby different parts of a multiple deck stack of cards are shuffled together, in a certain sequence, in order to randomize the multiple deck stack or cards without ever having to shuffle more than a single deck amount of cards at a time. The ABC shuffle involves multiple shuffles of the same cards. The ABC hand shuffle actually involves two distinct processes, with each process involving a number of steps.

Step 1 of the ABC hand shuffle is to divide a multiple deck stack of playing cards about the middle to form a left and right stack. Step 2 is to remove approximately one half of a deck of playing cards from the top of both the left and right stacks, shuffle these two groups of cards together using the standard riffle, riffle, strip, riffle shuffle, and place the shuffled cards on the table in-between the left and right stacks to start a new middle stack of cards.

Step three is to remove approximately one half of a deck of cards from the top of the left and middle stacks, shuffle these two groups of cards together, as described, and place the shuffled cards on the existing middle stack of cards. Step four is to remove approximately one half of a deck of cards from the top of the right and middle stacks, shuffle these two groups of cards together as described place the shuffled cards on the existing middle stack of cards. Steps three and four are then repeated until the left and right stacks are depleted and there is only one middle stack of cards. The multiple deck stack of cards is then ready for the second process of the ABC shuffle.

To begin the second process, the complete multiple deck group of cards is again cut in half to form left and right stack. This time again a group of cards consisting of one half of deck of cards is removed from the top of both the new left and right stacks riffled together one time and placed on the table in-between the left and right stacks to start a new middle stack of cards. This step just described, taking from both the left and right stacks riffling together once and placing the result on the middle stack, is repeated until the left and right stacks are depleted and there is only one middle stack of cards, which completes the ABC hand shuffle.

Detailed Description

Multiple Deck Single Pass Embodiment

The shuffler described in the above embodiments may be built to accommodate a different number of decks at a time, such as two, four, six, or eight decks, with N being the number of decks. For this discussion we will let N be six decks.

Figure 5:
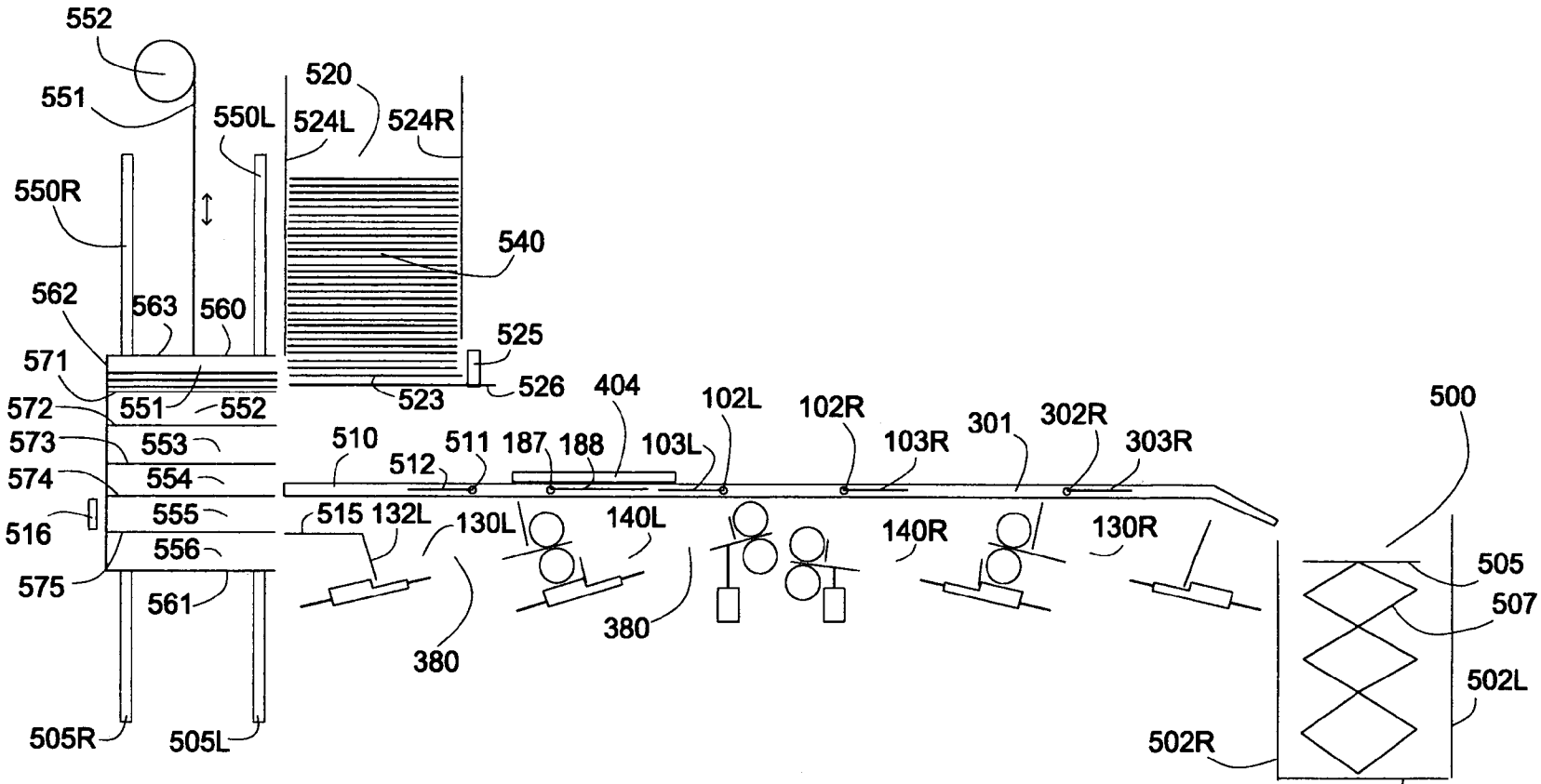
FIG. 5 is a cross section of a further embodiment of the invention.

FIG. 5 shows an embodiment of the shuffler for use in shuffling multiple decks of cards in one pass through the shuffler. Output hopper 360, previously shown, is replaced by multiple deck output hopper 500. Multiple deck output hopper 500 is formed by left and right upper walls 502R and 502L and bottom plate 503. Playing cards would sit on plate 505 which is mounted to spring 507. Spring 507 is shown fully extended. Plate 500 moves downward as playing cards accumulate on top of it, with the space between the topmost playing card and the end of outer case 301 always being less than the width of a playing card to keep a playing card from tumbling. Alternative means are possible, such as an elevator platform.

On the left part of outer case 510, instead of a downward bump there is now have a left outer hopper deflector 512, shown retracted. Deflector 512 is extended the same as left inner hopper deflector 103L, by left outer hopper rotary solenoid 511. Below the left part of outer case 510 is guide plate 515, which is attached to left upper wall 132L. Input hopper 370, as previously shown, is replaced by multiple deck input hopper 520 and carriage assembly 560, as will be described. Multiple deck input hopper 520 consists of left and right upright walls 524R and 524L and bottom plate 523. Pusher 525 rides on rail 523 so as to be horizontally movable from the position as shown over to left upright wall 524L. A solenoid, not shown, or other device is used to move pusher 525.

Carriage assembly 560 is formed by top wall 563, left wall 562 and bottom wall 561, and is subdivided into sections 551 through 556 by dividers 571 through 575. Each section is big enough to accommodate a single deck of cards. Enough sections are provided to accommodate the desired number of decks to be handled, in this case six.

Carriage assembly 560 is vertically movable along left and right rails 505R and 505L, by cable 551 which is controlled by motor 552. The upmost position of carriage assembly 560 is with bottom plate 561 lined up with bottom plate 523. The most downward movement of carriage assembly 560 is with divider 571 lined up with guide plate 515, as shown in FIG. 5.

Pusher 516 is shown, in its retracted position, the left of carriage assembly 560. It is extended to the right until even with left outer hopper upper wall 132L. A solenoid, not shown, or other movement device, and guide rails not shown.

Operation—Multiple Deck Single Pass Embodiment

The operator places multiple deck stack of cards 540 into input hopper 520. Carriage assembly 560 is then moved by motor 552 so that the upper part of first section 551 lines up with bottom plate 523. Pusher 525 then is operated to move a group of playing cards from multiple deck stack of cards 540 from input hopper 520 into first section 551. Pusher 525 is sized to move 1/N of the number of cards in a deck, in this case one sixth of a deck of cards. Carriage assembly 560 is then moved upward until the next section, 552, is set to receive cards. Cards are then moved by pusher 525 to section 552. This process is repeated until a sixth deck of cards is placed into sixth section 556. Carriage assembly 560 is then lowered again and the process repeated again, another one sixth deck of cards placed into each section of carriage assembly 560. This continues until input hopper 520 is empty and multiple deck stack of cards 540 is contained in carriage assembly 560.

After the above process is completed carriage assembly 560 is then moved until divider 571 is lined up with guide 515. Left outer hopper diverter arm 512 is then retracted, and pusher 516 is used to move the contents of section 551 into left outer hopper 130L. Left outer hopper diverter arm 512 is then extended downwardly and a shuffle is executed as previously described with the right outer hopper diverter arm 303R being retracted on the last interlacing causing all of the interlaced cards to wind up in multiple deck output hopper 500. The above process is then repeated for the remaining sections of carriage assembly 560, at which time all of the multiple deck stack of cards will be in multiple deck output hopper 500.

Alternative Embodiment

Multiple Deck Multiple Pass

Figure 6:
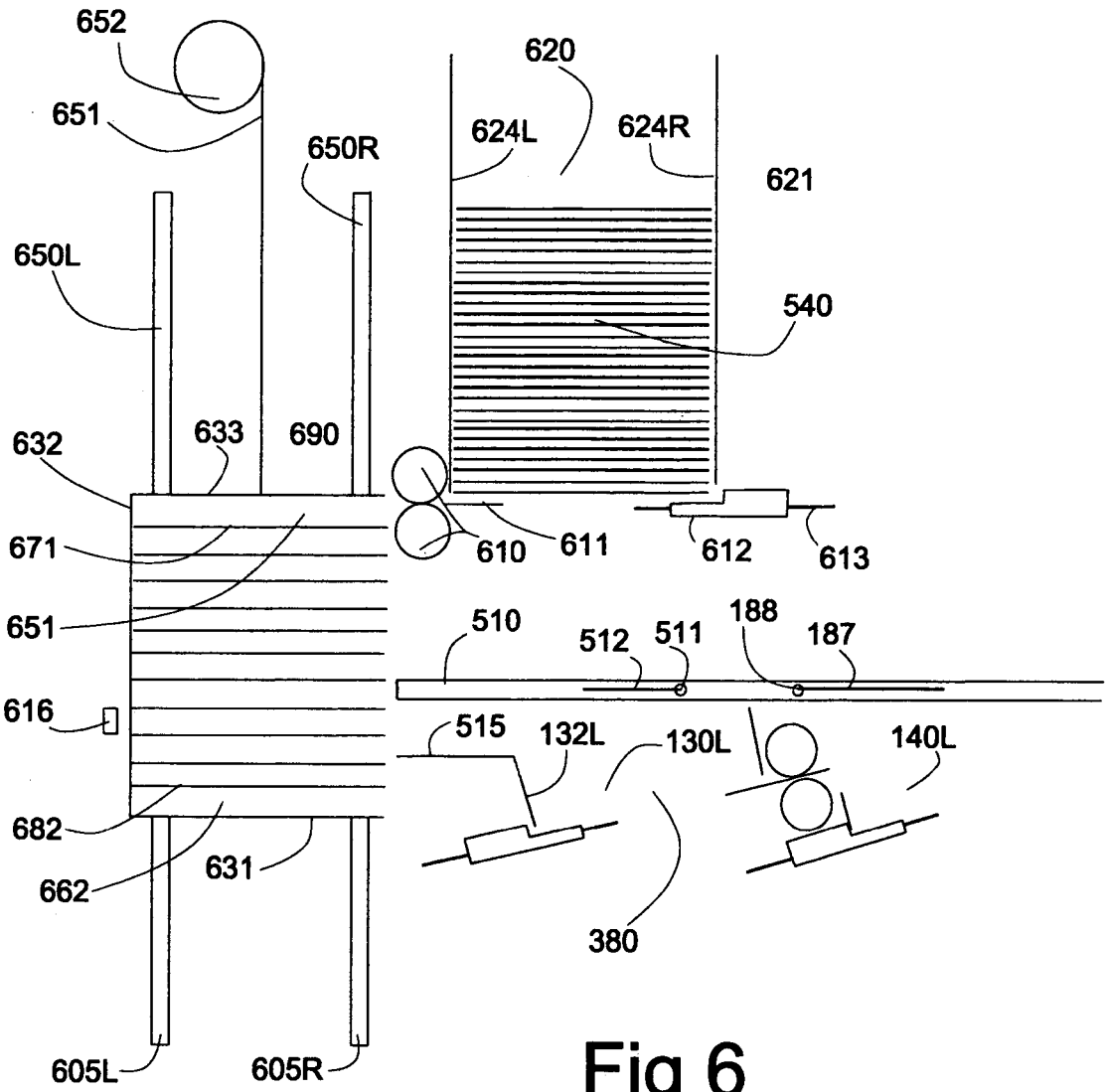
FIG. 6 is a different embodiment of the invention.

FIG. 6 shows another embodiment of a multiple deck input hopper 620 and carriage assembly 690. Multiple deck input hopper 620 consists of left and right upright walls 624R and 624L bottom plate 611, and slide 612. Slide 612 rides on rail 613, and is driven by a crank off a stepper motor, as previously described for other hoppers. The movement of slide 612 propels one card at a time into drive wheels 610.

Carriage assembly 690 is formed by top wall 633, left wall 632 and bottom wall 631, and is subdivided into sections 651 through 662 by dividers 671 through 682. Each section is big enough to accommodate one half of a deck of cards. Enough sections are provided accommodate the desired number of decks to be handled, in this case twelve sections to handle six decks.

Carriage assembly 690 is vertically movable along left and right rails 605R and 605L, by cable 651 which is controlled by motor 652. The upmost position of carriage assembly 690 is with bottom plate 631 lined up with bottom plate 611. The most downward movement of carriage assembly 690 is with divider 671 lined up with guide plate 515. Pusher 616 is shown, in its retracted position, to the left of carriage assembly 690. Pusher 616 can be extended to the right to empty a compartment until it is even with left outer hopper upper wall 132L. A solenoid, not shown, or other movement device, and guide rails (not shown) are used to effect this movement of the pusher 616.

Operation—Multiple Deck Multipass

The operator places multiple deck stack of cards 540 into input hopper 620. Carriage assembly 690 is then moved by motor 652 so that the upper part of last section 662 lines up with bottom plate 611. Slide 612 then moves the desired number of cards 540, approximately one half of a deck one at a time, from input hopper 620 into bottom section 662. Carriage assembly 690 is then moved downward until the next section, 661, is set to receive cards. Cards are then again loaded by slide 612. This process continues until input hopper 620 is empty and multiple deck stack of cards 540 is contained in carriage assembly 690. Individual groups of cards can now be moved from the sections of carriage 690 as needed into left outer hopper 130L by use of pusher 616.

Referring to FIG. 6 columns one and two, storage compartments 651 through 662 each contain a half deck in the original order that the cards were in. Following the ABC hand shuffle previously discussed, the original stack of cards is first cut in half into a left and right stack. Then a half deck from the top of the left and right stacks are shuffled together. This corresponds to shuffling the first and seventh half decks in the original stack. Referring to FIG. 7, column 3 shows that half decks one and seven are the first and second half decks brought into the shuffler for the first pass.

The contents of individual sections are brought into the shuffler one at a time by activation of pusher 616. After the first half deck is brought into left outer hopper 130L it is immediately moved to left inner hopper 140L as previously described for cutting a deck. The next half deck to be processed is then brought into left outer hopper 130L and shuffling of the two half decks can commence. On the last interlacing, left inner hopper diverter 103L is extended and a new first half deck of cards is interlaced into left inner hopper 140L. Left inner hopper diverter 103L and outer hopper diverter 512 are then both retracted a new second half deck of cards is propelled into the last emptied section of carriage assembly 690.

In terms of the ABC shuffle, the top half deck of the left and right stacks have been shuffled together. In the ABC shuffle, the resultant full deck would be placed in the middle as a new stack, and then a half deck from the right stack and the middle stack would be shuffled together. Rather than placing all of the output in a middle stack and picking it up again, a half deck of the middle stack is left in the shuffler and a new half deck is brought in for the next interlacing.

Referring to FIG. 7, the last half deck brought in to be shuffled, number 2 in column three, receives the first half output deck, number 1 in column four. The first output half deck would be the bottom of the new middle stack, noted by the 12 in column 5 of FIG. 7. The next half deck to be shuffled, number 3 in column three is then brought into the shuffler to be shuffled against the half deck remaining in the shuffler from the previous shuffle. This process is repeated until all decks have gone through a first pass, at which time in terms of the ABC shuffle there would be no left and right stacks, just a middle stack, which would be divided again into a new left and right stack to be interlaced.

In terms of the operation of the shuffler, after the first pass of all the half decks, eleven new half decks are contained in the storage compartments of carriage 560, with corresponding positions in a new middle deck given in column 5 of table 7. The last half deck, the top of the new middle deck is still in the shuffler. The second process, simple interlacing, now commences, with the new first half deck of the right stack, still in the shuffler, being interlaced against the new first half deck of the left stack, which is the seventh half deck of the new middle stack. As indicated by the 1 in column 6 of FIG.

7, the first half deck to be brought in, is position 7 in the new stack, the 7 in column 5 of FIG. 7.

As these two half decks are interlaced, output is propelled directly into multiple deck output hopper 500, shown in FIG. 5. This simple process of bringing half decks in, in the correct order, and interlacing them directly into multiple deck output hopper 500 continues until carriage 690 is empty.

Alternative Methods of Processing

While the operation of the device as described above follows the process of a dealer manually shuffling a multiple deck stack of cards, deviations from that process could be made, all of which have been contemplated, most of which would not require any change to the components of the device.

Alternative Placement of Components

The device could be as easily designed with the input and output hoppers both placed to the right of storage compartments 300, with the input hopper directly above the output hopper to make the invention more convenient for the operator. Other alternative designs could be made to adapt this concept to work with other single deck shufflers of completely different design.

Alternative Methods of Loading

Two methods of moving cards from the input hopper to storage compartments have been disclosed. These methods could be interchanged, or another method used. An alternative method of moving cards one at a time to different storage compartments could consist of propelling the cards through a series of gates, the positioning of which would control which card went to which compartment. The multiple deck input hoppers could also be top feed instead of bottom feed hoppers. With the bottom feed hoppers as described, some method of lifting some of the cards up may be employed, to reduce the pressure on the bottom most cards.

The foregoing description of the embodiments of the invention is to be considered illustrative and not as limiting. Various changes and modifications will occur to those skilled in the art for performing substantially the same function, in substantially the same way, to achieve substantially the same results without departing from the true scope of the invention as defined in the appended claims.

What is claimed is:

1. An automated playing card shuffling system including in combination:

a deck of cards;

first and second pairs of card hoppers;

a first mechanism for selectively removing the cards from either hopper of the first pair of hoppers and interlacing the cards into the second pair of hoppers;

a second mechanism for selectively removing the cards from either hopper of the second pair of hoppers and interlacing the cards into the first pair of hoppers;

a control device coupled with the first and second mechanisms to effect the selective removal of the cards from the first and second pairs of hoppers and to effect alternating operations of the first and second mechanisms.

2. A card shuffling system according to claim 1 further including at least first and second movable diverter arms coupled with the control device and operated in synchronism with the first and second mechanisms for directing cards removed from the first pair of hoppers, selectively, into one or the other of the hoppers of the second pair of hoppers and for directing cards removed from the second pair of hoppers into one or the other of the hoppers of the first pair of hoppers.

3. A card shuffling system according to claim 2 further including sensors associated with each of the hoppers of the first and second pairs of card hoppers coupled with the control device to provide signals to the control device indicative of the presence or absence of cards in the associated hoppers, whereupon signals from the associated sensors enable the control device to monitor the operation of the first and second mechanisms.

4. A card shuffling system according to claim 3 wherein the control device includes a microprocessor.

5. A card shuffling system according to claim 1 wherein the cards are removed by the first mechanism into a selected one of the hoppers of the second pair of hoppers.

6. A card shuffling system according to claim 5 further including a control device coupled with the first and second mechanisms to effect alternating operations of the first and second mechanisms.

7. A card shuffling system according to claim 1 further including sensors associated with each of the hoppers of the first and second pairs of card hoppers coupled with the control device to provide signals to the control device indicative of the presence or absence of cards in the associated hoppers, whereupon signals from the associated sensors enable the control device to monitor the operation of the first and second mechanisms.

8. A card shuffling system according to claim 7 wherein the control device includes a microprocessor.

9. A card shuffling system according to claim 1 wherein the control device includes a microprocessor.

10. A card shuffling system according to claim 1 further including an input hopper and an output hopper, an output diverter, and further mechanisms for removing cards from the input hopper and supplying them to a hopper of the first pair of hoppers of the shuffling system; whereupon, at the end of a shuffling sequence, operation of the output diverter causes cards to be delivered from the first pair of hoppers in response to the operation of the first mechanism into the output hopper.

11. A card shuffling system according to claim 10 wherein the input hopper and the output hopper each have a capacity of multiple decks of cards.

12. A card shuffling system: according to claim 11 further including a control device and a delivery mechanism coupled with the input hopper and controlled by the control device to deliver cards to the first pair of hoppers in predetermined quantities less than the full quantity of cards initially placed in the input hopper.

13. A card shuffling system according to claim 12 wherein the control device includes a microprocessor.

14. A card shuffling system according to claim 13 further including sensors associated with each of the hoppers of the first and second pairs of card hoppers coupled with the control device to provide signals to the control device indicative of the presence or absence of cards in the associated hoppers, whereupon signals from the associated sensors enable the control device to monitor the operation of the first and second mechanisms.

15. A method for automatically shuffling at least one deck of playing cards including:

providing a deck of cards;

providing first and second pairs of card hoppers;

providing a first mechanism and a second mechanism;

placing portions of the deck of cards in the hoppers of the first pair of hoppers;

operating the first mechanism, the first mechanism selectively removing the cards from either hopper of the first pair of hoppers and interlacing the cards into the second pair of hoppers;

operating the second mechanism, the second mechanism selectively removing the cards from either hopper of the second pair of hoppers and interlacing the cards into the first pair of hoppers;

a control device coupled with the first and second mechanisms to effect the selective removal of the cards from the first and second pairs of hoppers and to effect alternating operations of the first and second mechanisms.

16. A method according to claim 15 wherein movement and interlacing cards from the first pair of hoppers to the second pair of hoppers and back again is repeated a predetermined number of times.

17. A method according to claim 16 further including cutting cards for a next shuffle from one pair of hoppers to another simultaneously as cards are being interlaced from one pair of card hoppers to another pair of card hoppers.

18. A method according to claim 15 further including cutting cards for a next shuffle from one pair of hoppers to another simultaneously as cards are being interlaced from one pair of card hoppers to another pair of card hoppers.

19. An automated card shuffling system including in combination:

a deck of cards;

first and second pairs of card hoppers;

a first mechanism for selectively removing the cards from either hopper of the first pair of hoppers and interlacing the cards into the second pair of hoppers;

a second mechanism for selectively removing the cards from either hopper of the second pair of hoppers and interlacing the cards into the first pair of hoppers; and a control device coupled with the first and second mechanisms to effect the selective removal of cards from the first and second pairs of hoppers to accomplish a shuffle operation.

20. An automated playing card shuffling system according to claim 19 wherein the control device includes a microprocessor.

21. A card shuffling system according to claim 20 further including at least first and second movable diverter arms coupled with the microprocessor and operated in synchronism with the first and second mechanisms for directing cards removed from the first pair of hoppers, selectively, into one or the other of the hoppers of the second pair of hoppers and for directing cards removed from the second pair of hoppers into one or the other of the hoppers of the first pair of hoppers.

* * * * *